US011248808B2

(12) United States Patent
Koda

(10) Patent No.: US 11,248,808 B2
(45) Date of Patent: Feb. 15, 2022

(54) OUTDOOR UNIT OF AIR-CONDITIONING APPARATUS

(71) Applicant: Mitsubishi Electric Corporation, Tokyo (JP)

(72) Inventor: Misaki Koda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 64 days.

(21) Appl. No.: 16/630,117

(22) PCT Filed: Sep. 14, 2017

(86) PCT No.: PCT/JP2017/033299
§ 371 (c)(1),
(2) Date: Jan. 10, 2020

(87) PCT Pub. No.: WO2019/053852
PCT Pub. Date: Mar. 21, 2019

(65) Prior Publication Data

US 2020/0200406 A1 Jun. 25, 2020

(51) Int. Cl.
*F24F 1/22* (2011.01)

(52) U.S. Cl.
CPC ..... *F24F 1/22* (2013.01)

(58) Field of Classification Search
CPC ..... F24F 1/22; F24F 13/222; F24F 2013/207; F24F 11/89
See application file for complete search history.

(56) References Cited

U.S. PATENT DOCUMENTS

2009/0007580 A1 1/2009 Sakashita et al.
2014/0298844 A1* 10/2014 Luo ..... F24F 1/18 62/275
2016/0131371 A1 5/2016 Aoyama et al.

FOREIGN PATENT DOCUMENTS

AU 2007210491 A1 8/2007
JP H05-66430 U 9/1993
JP 2012-013404 A 1/2012
JP 2013-164249 A 8/2013
(Continued)

OTHER PUBLICATIONS

Office Action dated Oct. 30, 2020 issued in corresponding DE patent application No. 112017008036.3 (and English machine translation).
(Continued)

*Primary Examiner* — Cassey D Bauer
(74) *Attorney, Agent, or Firm* — Posz Law Group, PLC

(57) ABSTRACT

An outdoor unit of an air-conditioning apparatus includes a housing, a heat exchanger provided in an upper part of an inside of the housing, and a control box disposed in the housing and configured to control the outdoor unit. The housing includes a base on which the control box is disposed and that is provided with a water drainage groove and a water drainage hole for draining defrost water generated on the heat exchanger to an outside, the base has three surfaces located at different heights that are, in order from top, a first surface, a second surface, and a third surface that is a bottom surface of the water drainage groove and is provided with the water drainage hole, and the control box is disposed on the first surface.

7 Claims, 7 Drawing Sheets

(56) References Cited

FOREIGN PATENT DOCUMENTS

| | | | |
|---|---|---|---|
| KR | 10-2002-0027839 | | 4/2002 |
| WO | 2014/196569 | A1 | 12/2014 |

OTHER PUBLICATIONS

International Search Report of the International Searching Authority dated Dec. 5, 2017 for the corresponding international application No. PCT/JP2017/033299 (and English translation).

* cited by examiner

OUTDOOR UNIT OF AIR-CONDITIONING APPARATUS

CROSS REFERENCE TO RELATED APPLICATION

This application is a U.S. national stage application of PCT/JP2017/033299 filed on Sep. 14, 2017, the contents of which are incorporated herein by reference.

TECHNICAL FIELD

The present invention relates to an outdoor unit of an air-conditioning apparatus applied, for example, to a variable refrigerant flow system.

BACKGROUND ART

An outdoor unit of an air-conditioning apparatus has an outer shell having, for example, a cuboid shape, and in consideration of maintainability, a heat exchanger is disposed along three side surfaces among four side surfaces excluding a side surface used for maintenance work (see, for example, Patent Literature 1). In the outdoor unit of Patent Literature 1, a control box for controlling devices contained in the outdoor unit is disposed in an upper part of an inside of a housing of the outdoor unit and disposed opposite the side surface used for maintenance work.

CITATION LIST

Patent Literature

Patent Literature 1: International Publication No. 2014/196569

SUMMARY OF INVENTION

Technical Problem

One measure to increase heat-exchange capability in an outdoor unit is to increase the number of surfaces along which a heat exchanger is disposed, specifically, dispose a heat exchanger along all of four side surfaces. In a case where the heat exchanger is disposed in this manner, there is no space where a control box, which needs to be accessed from an outside of a housing, is disposed. To solve this problem, a configuration may be conceived in which a heat exchanger is disposed along all of four side surfaces in an upper part of an inside of a housing and a control box is disposed in a lower part of the inside of the housing.

An air-conditioning apparatus performs defrosting operation for melting frost generated on a heat exchanger during heating operation in winter. As a result of the defrosting operation, water (hereinafter referred to as defrost water) molten by the defrosting operation flows down onto a base that constitutes a bottom surface of a housing. In a case where a control box is disposed in a lower part of an inside of the housing, the defrost water that flows down from the heat exchanger during the defrosting operation is accumulated on the base, and a bottom part of the control box is immersed in the accumulated defrost water. Because of the possible immersion, electric leakage may be undesirably caused. For this reason, it is necessary to take a countermeasure against such inconvenience in a case where a control box is disposed below a heat exchanger. However, in Patent Literature 1, as only a configuration is considered in which a controller is disposed in an upper part of an inside of a housing, the countermeasure against such immersion is not taken at all.

The present invention has been accomplished to solve the above problem, and an object of the present invention is to provide an outdoor unit of an air-conditioning apparatus in which a control box is disposed below a heat exchanger and the control box is less likely to be immersed in water.

Solution to Problem

An outdoor unit of an air-conditioning apparatus according to an embodiment of the present invention includes a housing, a heat exchanger provided in an upper part of an inside of the housing, and a control box disposed in the housing and configured to control the outdoor unit. The housing includes a base on which the control box is disposed and that is provided with a water drainage groove and a water drainage hole for draining defrost water generated on the heat exchanger to an outside, the base has three surfaces located at different heights that are, in order from top, a first surface, a second surface, and a third surface that is a bottom surface of the water drainage groove and is provided with the water drainage hole, and the control box is disposed on the first surface.

Advantageous Effects of Invention

According to an embodiment of the present invention, a base on which a control box is provided has three surfaces that are located at different heights, and the control box is disposed on a first surface located at the highest position among the three surfaces. This configuration can make it less likely that the control box be immersed in water.

DESCRIPTION OF EMBODIMENTS

Embodiments of the present invention are described below with reference to the drawings.

In Embodiment 1, for example, defrost water generated during defrosting operation of a variable refrigerant flow system is received by a base provided below a heat exchanger. Consequently, electric leakage caused by the defrost water is made less likely to occur.

Embodiment 1

Figure 1:
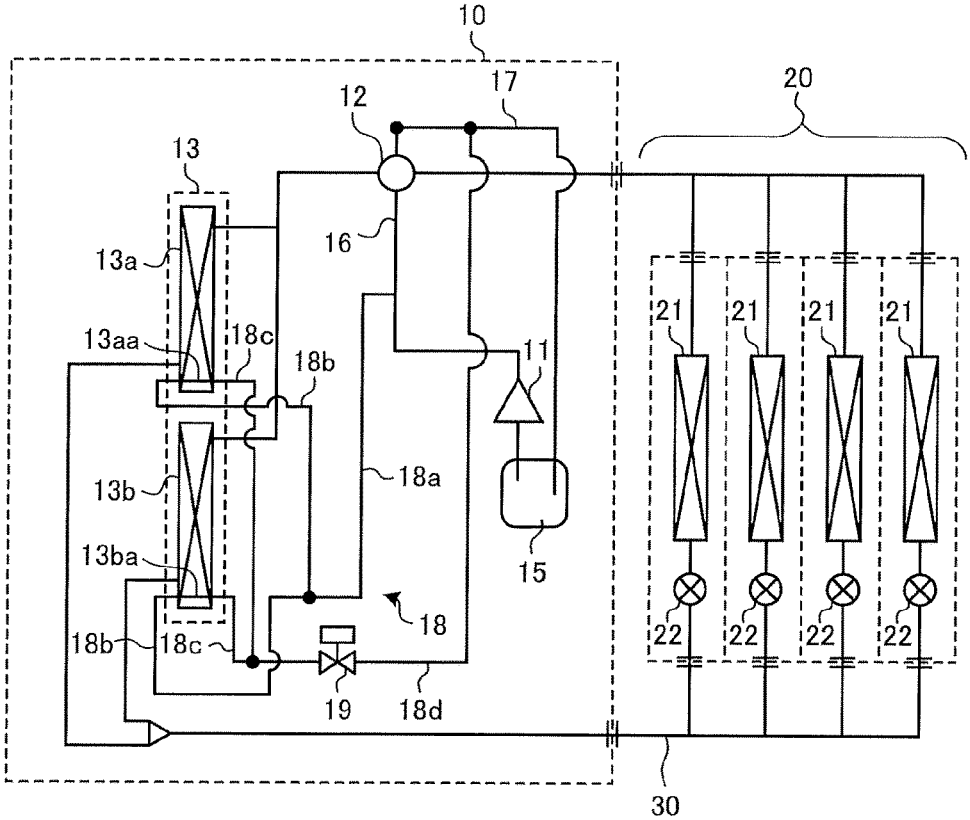
FIG. 1 schematically illustrates an example of a circuit configuration of an air-conditioning apparatus according to Embodiment 1 of the present invention.

FIG. 1 schematically illustrates an example of a circuit configuration of an air-conditioning apparatus according to Embodiment 1 of the present invention. A detailed circuit configuration of the air-conditioning apparatus is described below with reference to FIG. 1. Although a case where four indoor units 20 are connected to an outdoor unit 10 is illustrated as an example in FIG. 1, the number of indoor units 20 is not limited.

As illustrated in FIG. 1, the air-conditioning apparatus according to Embodiment 1 includes an outdoor unit 10, a plurality of indoor units 20, and a refrigerant pipe 30 that connects the outdoor unit 10 and the indoor units 20. In this air-conditioning apparatus, four indoor units 20 are connected in parallel to each other and connected to the outdoor unit 10.

[Outdoor Unit]

The outdoor unit 10 includes a compressor 11, a flow switching device 12 such as a four-way valve, an outdoor-side heat exchanger 13, an accumulator 15, and an outdoor-side fan (not illustrated) that supplies air to the outdoor-side heat exchanger 13. The compressor 11 is, for example, an inverter compressor whose capacity can be controlled. The compressor 11 suctions low-temperature low-pressure gas refrigerant, compresses the gas refrigerant into high-temperature high-pressure gas refrigerant, and discharges the high-temperature high-pressure gas refrigerant. The flow switching device 12 switches between flow of refrigerant during a heating operation mode and flow of refrigerant during a cooling operation mode or defrosting operation.

The outdoor-side heat exchanger 13 includes an outdoor-side heat exchanger 13*a* and an outdoor-side heat exchanger 13*b*, each of which has, for example, an L-shape. A corner of the outdoor-side heat exchanger 13*a* and a corner of the outdoor-side heat exchanger 13*b* are disposed diagonally opposite to each other and thus the outdoor-side heat exchanger 13*a* and the outdoor-side heat exchanger 13*b* constitute a quadrangular heat exchanger. In this case, an outdoor-side fan is disposed above the outdoor-side heat exchanger 13. Furthermore, a machine room in which components such as the compressor 11, the flow switching device 12, and the accumulator 15 are disposed is provided below the outdoor-side heat exchanger 13. Furthermore, the machine room is provided with a front panel that is opened and closed for maintenance.

The outdoor-side heat exchanger 13 is used as an evaporator during a heating operation mode and is used as a condenser during a cooling operation mode and a defrosting operation mode. The outdoor-side heat exchanger 13 exchanges heat between air sent by the outdoor-side fan and refrigerant. The accumulator 15 is provided to an intake port of the compressor 11 and accumulates in the accumulator 15 excess refrigerant that is generated because of a difference between the heating operation mode and the cooling operation mode and excess refrigerant that is generated in transition of operation.

A bypass 18 is provided in the outdoor unit 10. The bypass 18 includes a first bypass pipe 18*a*, a second bypass pipe 18*b*, a third bypass pipe 18*c*, and a fourth bypass pipe 18*d*. Note that detailed description of the configuration of the bypass 18 and description of flow of refrigerant in the bypass 18 are omitted as the bypass 18 is irrelevant to the gist of the present invention.

The first bypass pipe 18*a* branches from a refrigerant pipe 16 between the compressor 11 and the flow switching device 12. The second bypass pipe 18*b* branches from the first bypass pipe 18*a* and is connected to one end of a heat transfer tube 13*aa* of the outdoor-side heat exchanger 13*a* and one end of a heat transfer tube 13*ba* of the outdoor-side heat exchanger 13*b*. The third bypass pipe 18*c* is pipes whose one ends are each connected to the corresponding one of the other end of the heat transfer tube 13*aa* and the other end of the heat transfer tube 13*ba* and whose other ends merge with each other. The fourth bypass pipe 18*d* branches from a refrigerant pipe 17 between the flow switching device 12 and the accumulator 15 and is connected to a merging point of the third bypass pipe 18*c*. A valve opening-closing device 19 is attached to the fourth bypass pipe 18*d*. The valve opening-closing device 19 is, for example, a solenoid valve.

[Indoor Unit]

The indoor units 20 include four indoor-side heat exchangers 21, expansion devices 22 that are each connected in series with the corresponding one of the four indoor-side heat exchangers 21, and an indoor-side fan (not illustrated) that supplies air to each of the indoor-side heat exchangers 21. Each of the indoor-side heat exchangers 21 is used as a condenser during a heating operation mode and is used as an evaporator during a cooling operation mode. Each of the indoor-side heat exchangers 21 exchanges heat between air supplied by the indoor-side fan and refrigerant and supplies cooling air or heating air to a space to be air-conditioned. Each of the expansion devices 22 is used as a pressure reducing valve or an expansion valve and expands refrigerant by reducing a pressure of the refrigerant. Each of the expansion devices 22 is, for example, an electronic expansion valve whose valve opening degree can be controlled.

Next, operation of the air-conditioning apparatus according to Embodiment 1 is described.

[Heating Operation Mode]

Figure 2:
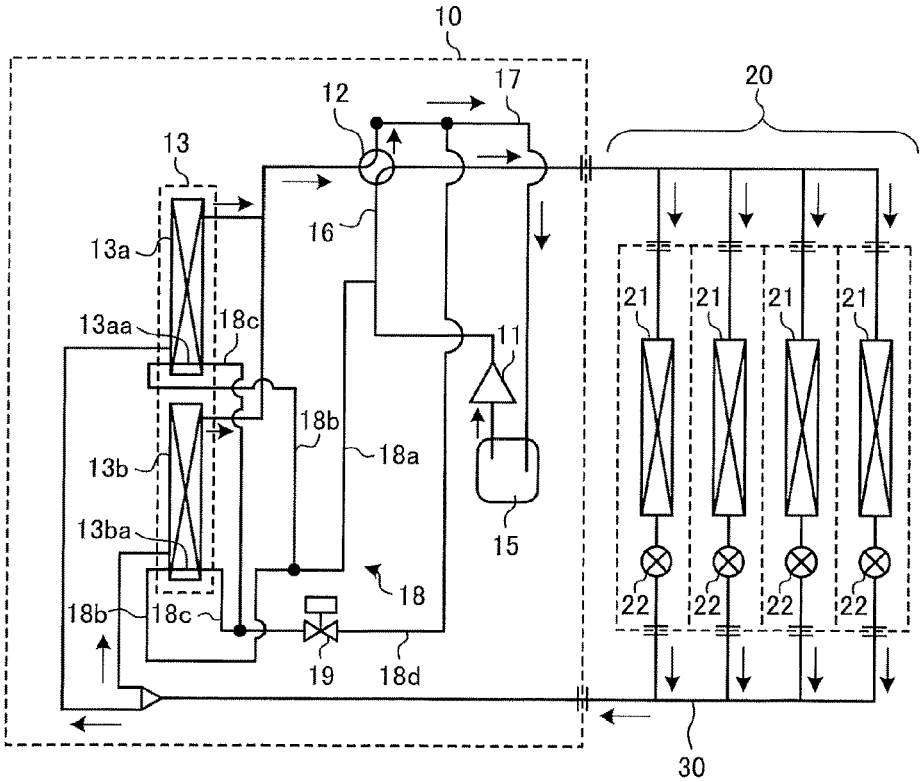
FIG. 2 is a refrigerant circuit diagram illustrating flow of refrigerant during a heating operation mode of the air-conditioning apparatus according to Embodiment 1 of the present invention.

FIG. 2 is a refrigerant circuit diagram illustrating flow of refrigerant during a heating operation mode of the air-conditioning apparatus according to Embodiment 1 of the present invention. FIG. 2 illustrates a case where all of the indoor units 20 are being driven, and the arrows in FIG. 2 represent directions of flow of refrigerant.

When the compressor 11 is driven, low-temperature low-pressure gas refrigerant flows into the compressor 11 and is compressed into high-temperature high-pressure gas refrigerant, and the high-temperature high-pressure gas refrigerant is discharged. The high-temperature high-pressure gas refrigerant discharged from the compressor 11 flows out from the outdoor unit 10 by passing through the flow switching device 12 and flows into each of the indoor-side heat exchangers 21 through the refrigerant pipe 30. The high-temperature high-pressure gas refrigerant that has flowed into the indoor-side heat exchangers 21 is condensed into low-temperature high-pressure liquid refrigerant by transferring heat to surrounding air through heat exchange with air supplied from the indoor-side fan, and the low-temperature high-pressure liquid refrigerant flows out from the indoor-side heat exchangers 21. The low-temperature high-pressure liquid refrigerant that has flowed out from the indoor-side heat exchangers 21 is depressurized into low-temperature low-pressure two-phase gas-liquid refrigerant by the expansion devices 22, and the low-temperature low-pressure two-phase gas-liquid refrigerant flows out from the indoor units 20.

The two-phase gas-liquid refrigerant that has flowed out from the indoor units 20 flows into the outdoor-side heat exchanger 13 of the outdoor unit 10 through the refrigerant pipe 30. The two-phase gas-liquid refrigerant that has flowed into the outdoor-side heat exchanger 13 evaporates into low-pressure gas refrigerant by receiving heat from surrounding air through heat exchange with air supplied from the outdoor-side fan, and the low-pressure gas refrigerant flows out from the outdoor-side heat exchanger 13. The gas refrigerant that has flowed out from the outdoor-side heat exchanger 13 enters the accumulator 15 through the flow switching device 12. The gas refrigerant that has entered the accumulator 15 is separated into liquid refrigerant and gas refrigerant, and the low-temperature low-pressure gas refrigerant is suctioned into the compressor 11 again. The suctioned gas refrigerant is compressed again by the compressor 11 and is then discharged. In this manner, the refrigerant is repeatedly circulated.

In a case where heating operation is continuously performed when an outside air temperature is low and where an evaporating temperature is less than or equal to 0 degrees C., frost is formed on a surface of the outdoor-side heat exchanger 13. The frost is generated because moisture included in air that exchanges heat forms dew on the surface of the outdoor-side heat exchanger 13 that receives heat as an evaporator. In a case where an amount of frost increases, thermal resistance increases, and an air volume decreases. The decrease in air volume also decreases a temperature (evaporating temperature) of the heat transfer tube of the outdoor-side heat exchanger 13. Consequently, it is impossible to fully use heating capacity. To fully use heating capacity, frost needs to be removed by defrosting operation.

[Defrosting Operation Mode]

Figure 3:
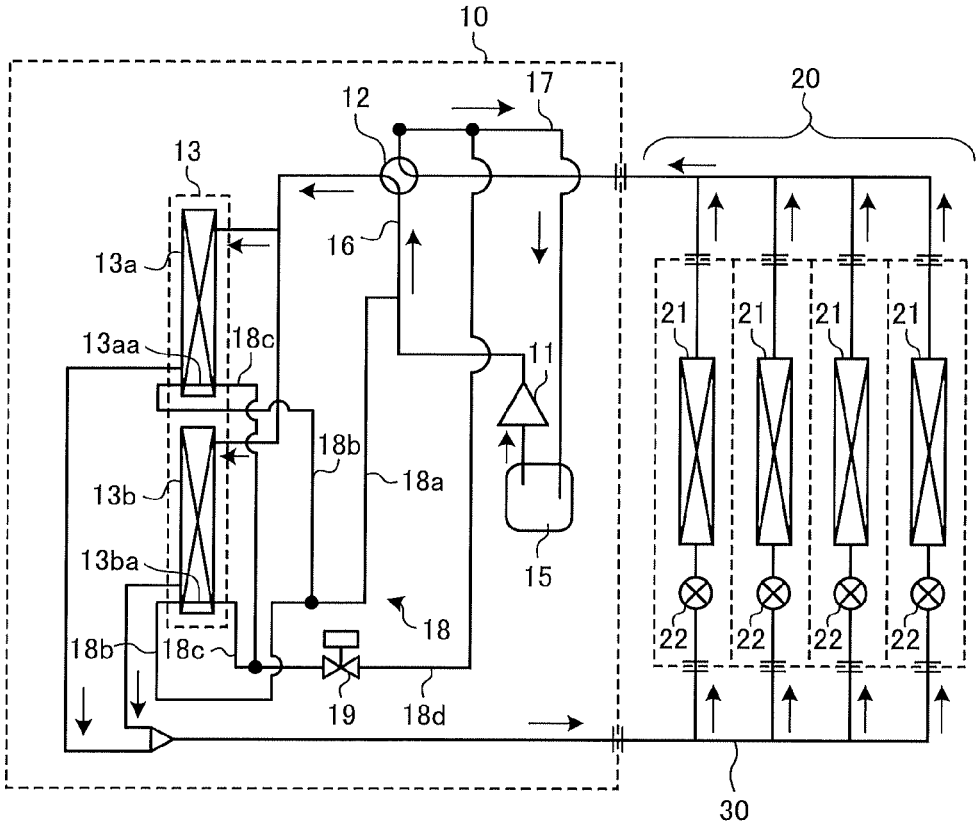
FIG. 3 is a refrigerant circuit diagram illustrating flow of refrigerant during a defrosting operation mode of the air-conditioning apparatus according to Embodiment of the present invention.

FIG. 3 is a refrigerant circuit diagram illustrating flow of refrigerant during a defrosting operation mode of the air-conditioning apparatus according to Embodiment of the present invention. FIG. 3 illustrates a case where all of the indoor units 20 are being driven, and the arrows in FIG. 3 represent directions of flow of refrigerant.

In defrosting operation, normal heating operation is interrupted, and refrigerant is circulated in a direction identical to a direction in cooling operation by the flow switching device 12. In this case, low-temperature low-pressure gas refrigerant flows into the compressor 11 and is compressed into high-temperature high-pressure gas refrigerant, and the high-temperature high-pressure gas refrigerant is discharged. The high-temperature high-pressure gas refrigerant discharged from the compressor 11 flows into the outdoor-side heat exchanger 13 by passing through the flow switching device 12.

The high-temperature high-pressure gas refrigerant that has flowed into the outdoor-side heat exchanger 13 transfers heat to surrounding air through heat exchange with air supplied from the outdoor-side fan and turns into low-temperature high-pressure liquid refrigerant. The transferred heat melts frost attached to the outdoor-side heat exchanger 13. At this time, the outdoor-side fan is not operating in many cases. The low-temperature high-pressure liquid refrigerant that has flowed out from the outdoor-side heat exchanger 13 flows into the indoor units 20 through the refrigerant pipe 30.

The low-temperature high-pressure liquid refrigerant that has flowed into the indoor units 20 is depressurized into low-temperature low-pressure two-phase gas-liquid refrigerant by the expansion devices 22. The two-phase gas-liquid refrigerant flows into the indoor-side heat exchangers 21, enters the outdoor unit 10 again without heat exchange while keeping the two-phase gas-liquid state, and enters the accumulator 15 through the flow switching device 12. The refrigerant that has entered the accumulator 15 is separated into liquid refrigerant and gas refrigerant, and the low-temperature low-pressure gas refrigerant is suctioned into the compressor 11 again. The suctioned gas refrigerant is compressed again by the compressor 11 and is then discharged. In this manner, the refrigerant is repeatedly circulated.

During the defrosting operation, defrost water generated when frost attached to the outdoor-side heat exchanger 13 melts drops and flows down through a fin of the outdoor-side heat exchanger 13 onto the base 2 (see FIG. 5, which will be described later) that constitutes a bottom surface of the housing 1 of the outdoor unit 10 because of gravity. The defrost water that has flowed down onto the base 2 is drained to an outside of the housing 1 of the outdoor unit 10 through water drainage holes 50 (see FIG. 5, which will be described later) opened in the base 2.

Figure 4:
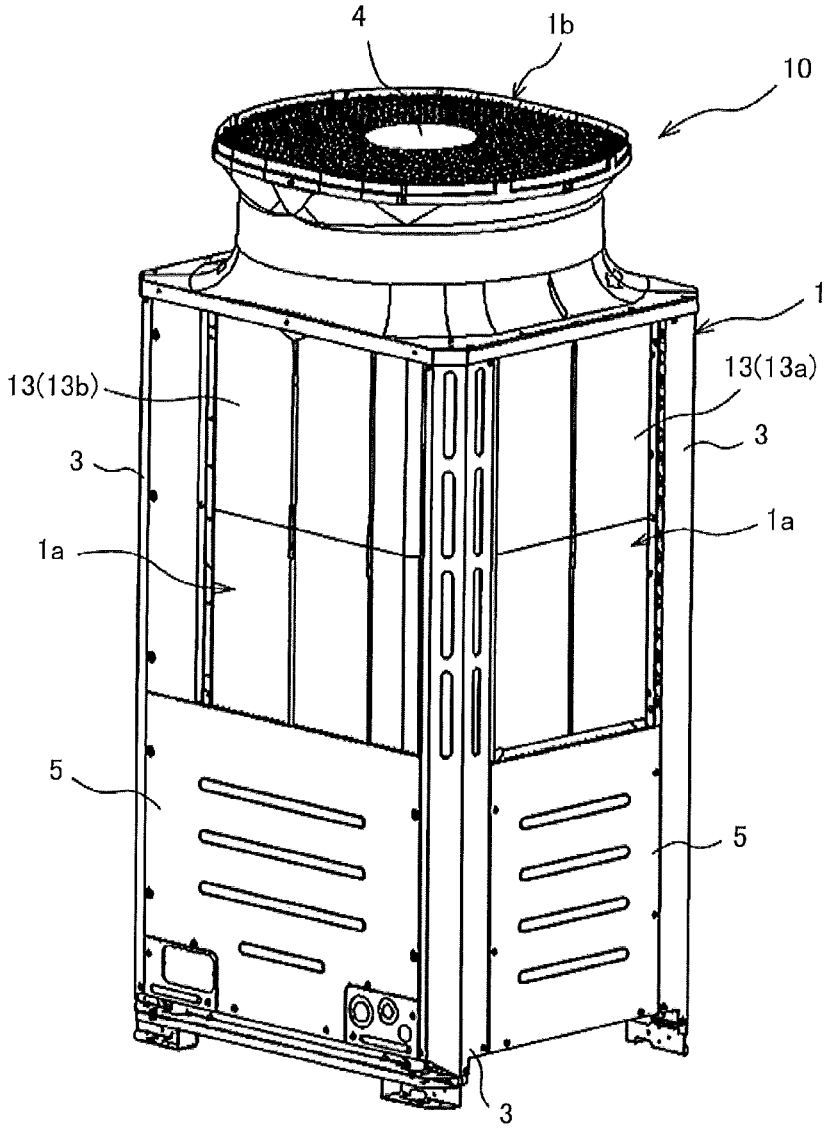
FIG. 4 is a perspective view schematically illustrating an outdoor unit of the air-conditioning apparatus according to Embodiment 1 of the present invention.
Figure 5:
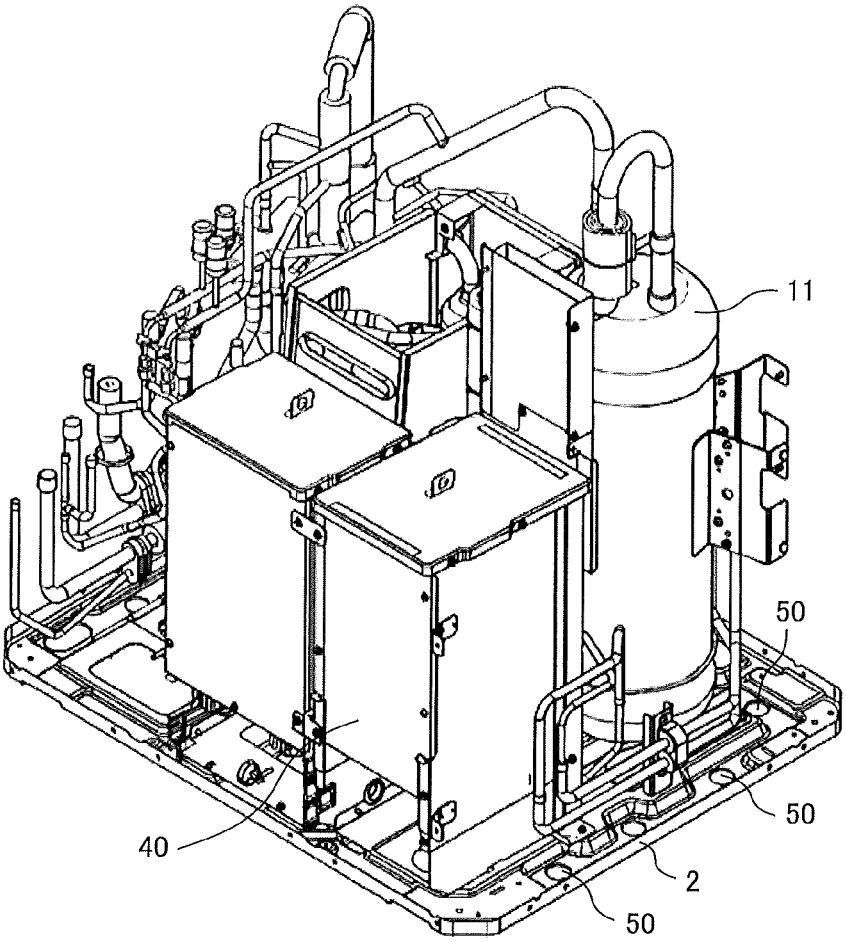
FIG. 5 is an enlarged perspective view of a machine room located in a lower part of an inside of the outdoor unit of FIG. 4.

FIG. 4 is a perspective view schematically illustrating the outdoor unit of the air-conditioning apparatus according to Embodiment 1 of the present invention. FIG. 5 is an enlarged perspective view of the machine room located in a lower part of an inside of the outdoor unit of FIG. 4.

As illustrated in FIGS. 4 and 5, the outdoor unit 10 according to Embodiment 1 is disposed in such a manner that the outdoor-side heat exchanger 13 is disposed in the housing 1 that has a substantially cuboid shape and is vertically placed.

As described above, the outdoor-side heat exchanger 13*a* and the outdoor-side heat exchanger 13*b* each having an L-shape are combined to constitute the outdoor-side heat exchanger 13 having a substantially square shape, and an outer side surface of the outdoor-side heat exchanger 13 is disposed along an inner side surface of the housing 1 although illustration of details of the outdoor-side heat exchanger 13 is omitted. The outdoor-side heat exchanger 13 is supported in an upper part of an inside of the housing 1 by a support table (not illustrated) provided in the housing 1.

The housing 1 includes frame parts 3 that each extend upward from the corresponding one of corners of the base 2 provided on the bottom surface. The housing 1 has, on an upper part of an outer peripheral surface of the housing 1 surrounded by the frame parts 3, air inlets 1*a* for suctioning air into the housing 1, and the outdoor-side heat exchanger 13 is disposed along the air inlets 1*a*. The housing 1 has an air outlet 1*b* in an upper surface of the housing 1, and the outdoor-side fan 4 is disposed directly below the air outlet 1*b* in the housing 1. When the outdoor-side fan 4 is driven, air suctioned into the housing 1 from the air inlets 1*a* exchanges heat with refrigerant by passing through the outdoor-side heat exchanger 13 and then the air is discharged from the air outlet 1*b* through the outdoor-side fan 4.

The housing 1 is provided with side panels 5 that are each a design plate. The side panels 5 are disposed in a lower part of the outer peripheral surface of the housing 1 surrounded by the frame parts 3 and seal openings at the lower portion of the housing 1. Left and right edges of each of the side panels 5 are each fixed to the corresponding one of the frame parts 3 with use of a fastening part such as a screw, and a lower edge of each of the side panels 5 is fixed to the base 2 with use of a fastening part such as a screw.

The inner lower part of the housing 1 is a machine room. In the machine room, components such as the compressor 11 and the control box 40 are disposed on the base 2 as illustrated in FIG. 5. The control box 40 contains, in the control box 40, a control substrate (not illustrated) that controls, for example, an opening degree of the expansion devices 22 and an inverter substrate (not illustrated) that controls, for example, a rotation frequency of the compressor 11. The control box 40 is exposed when one of the side panels 5 is detached from the housing 1. The exposure allows, for example, maintenance of the control box 40 from an outside of the housing.

A large amount of defrost water is generated in a high-humidity environment as the defrosting operation is performed at a cycle of approximately one time per hour. In a case where the defrost water continues to flow onto the base 2 and is not sufficiently drained, there is a risk of immersion of the control box 40 in the water and a risk of freezing of the defrost water and growth of ice in a case where the operation switches to heating operation before the water is sufficiently drained.

In view of the risks, in Embodiment 1, the control box 40 is made less likely to be immersed in water by specifying a base structure on which the control box 40 is provided and a position where the control box 40 is disposed. This configuration is described below.

Figure 6:
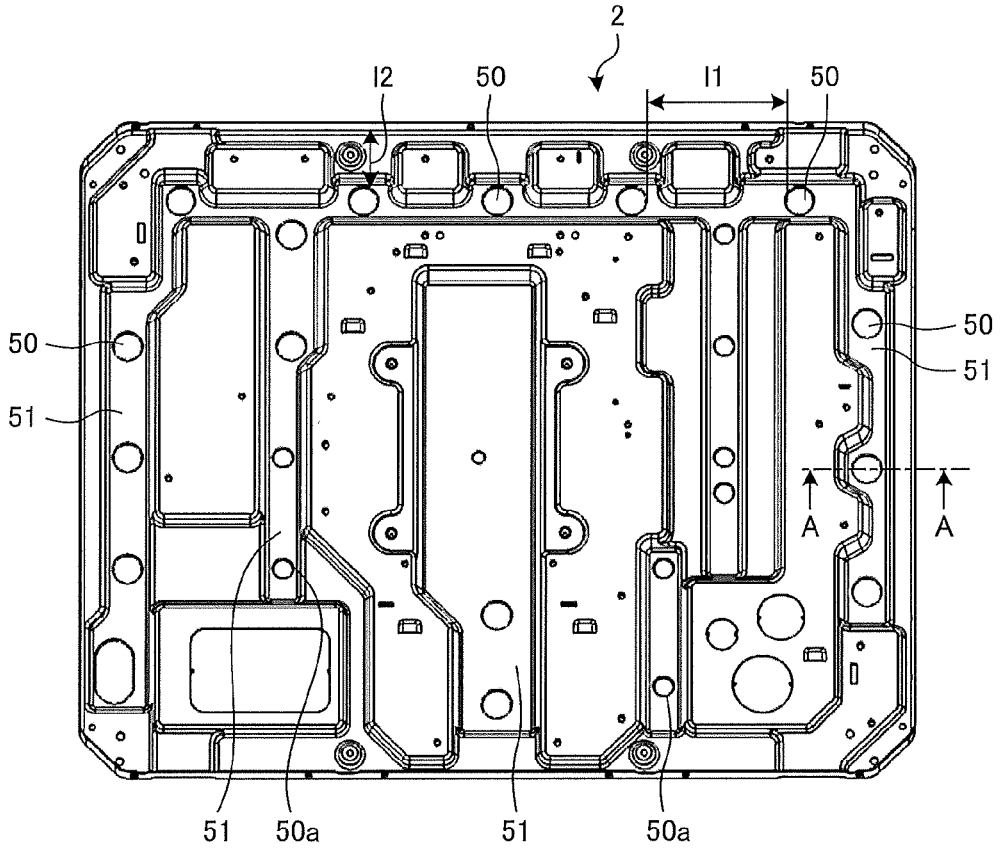
FIG. 6 is a plan view illustrating a structure of a base of the outdoor unit of the air-conditioning apparatus according to Embodiment 1 of the present invention.
Figure 7:
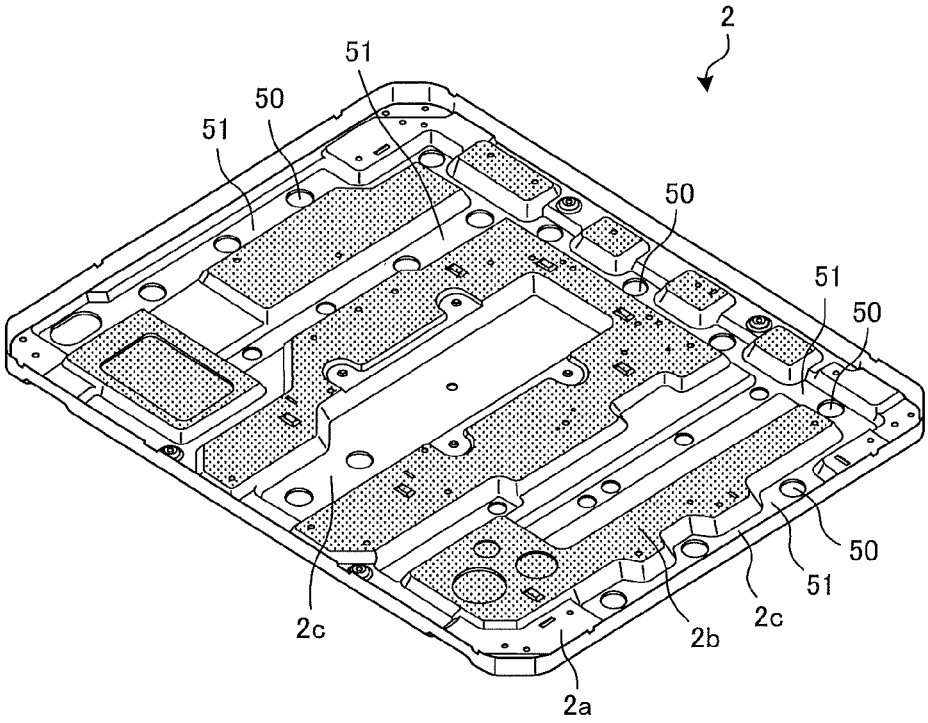
FIG. 7 is a perspective view of the base of the outdoor unit of the air-conditioning apparatus according to Embodiment 1 of the present invention.
Figure 8:
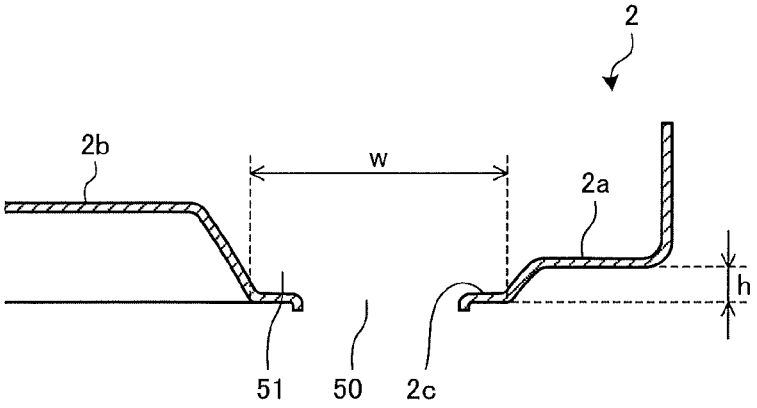
FIG. 8 is a cross-sectional view taken along A-A of FIG. 6.

FIG. 6 is a plan view illustrating a structure of the base of the outdoor unit of the air-conditioning apparatus according to Embodiment 1 of the present invention. FIG. 7 is a perspective view of the base of the outdoor unit of the air-conditioning apparatus according to Embodiment 1 of the present invention. FIG. 8 is a cross-sectional view taken along A-A of FIG. 6.

The base 2 has a substantially rectangular shape and has the water drainage holes 50 that drain, to an outside, defrost water that has flowed down from the outdoor-side heat exchanger 13 onto the base 2 during the defrosting operation and water drainage grooves 51 that guide the defrost water to the water drainage holes 50.

The base 2 is provided with ribs having different heights so that structural strength is obtained and has a plurality of surfaces located at different heights accordingly. Specifically, as illustrated in FIG. 8, the base 2 has three surfaces, specifically, a reference surface 2*a*, a topmost surface 2*b* higher than the reference surface 2*a*, and a water drainage surface 2*c* lower than the reference surface 2*a*. The parts represented by the dotted hatching in FIG. 7 represent the topmost surface 2*b*. The water drainage surface 2*c* constitutes a bottom surface of the water drainage grooves 51, and the water drainage holes 50 are opened in the water drainage surface 2*c*. That is, the base 2 has three surfaces located at different heights, specifically, the topmost surface 2*b*, the reference surface 2*a*, and the water drainage surface 2*c* in order from top. The topmost surface 2*b* corresponds to a first surface of the present invention, the reference surface 2*a* corresponds to a second surface of the present invention, and the water drainage surface 2*c* corresponds to a third surface of the present invention.

In Embodiment 1, the control box 40, which is disposed on the base 2 as described above, is disposed especially on the topmost surface 2*b* of the base 2. With this configuration, the control box 40 is less likely to be immersed in defrost water. A region where the control box 40 is disposed on the topmost surface 2*b* is surrounded by the water drainage surface 2*c*. That is, the water drainage surface 2*c* located at a height lower than the region where the control box 40 is disposed is provided around the region where the control box 40 is disposed. As defrost water is accumulated in a part around the control box 40, the control box 40 is further less likely to be immersed in the defrost water.

Furthermore, durability can be improved by also disposing a heavy device such as a compressor on the topmost surface 2*b* and specifying an area of this topmost surface 2*b* to a minimum area having strength with which the weight of the device can be supported.

Next, specifications of a width and a depth of each of the water drainage grooves 51 and a length of a water drainage path that are for improving water drainage performance are described. The base 2 is not limited to the shape and the size illustrated in FIGS. 5 and 6 as long as the following specifications are met.

<Width and Depth of Water Drainage Grooves 51>

A width w and a depth h of each of the water drainage grooves 51 are specified so that defrost water is not frozen while the defrost water is flowing through the water drainage grooves 51. The width w of each of the water drainage grooves 51, that is, the width w of each part of the water drainage surface 2*c* is specified to less than or equal to 22 mm on the basis of a heat capacity of the base 2 and an outside air temperature to reduce heat transfer of water. A dehumidification water amount can be obtained from a horsepower of the outdoor unit 10, the number of surfaces along which the outdoor-side heat exchanger 13 is disposed, and an area of a front surface of the outdoor-side heat exchanger 13. When a total amount of defrost water generated in the outdoor unit 10 that has an 18 horsepower and four surfaces along which the outdoor-side heat exchanger 13 is disposed is 3.5 kg, an amount of water per surface is approximately 0.9 kg in one defrosting operation. During defrosting control, defrost water flows down uniformly from the whole outdoor-side heat exchanger 13, and empirically, approximately three minutes to six minutes are required for the defrost water to flow down from the outdoor-side heat exchanger 13 and be drained to an outside. The depth of each of the water drainage grooves 51 is designed in view of these factors and in consideration of the length of each of the water drainage grooves 51, which will be described later.

<Length of Water Drainage Path>

In a case where the length of the water drainage path, that is, the water drainage grooves 51 are too long, defrost water is more likely to be frozen before the defrost water is drained to an outside. For this reason, the length of the water drainage grooves 51, specifically, an interval 11 (see FIG. 6) between the water drainage holes 50 is specified to less than or equal to 500 mm. Furthermore, a distance 12 (see FIG. 6) between a part onto which defrost water falls and one of the water drainage holes 50 is also specified to less than or equal to 500 mm. This length is a length that allows water having a water temperature of 1 degree C. to flow through the water drainage grooves 51 each having a width of 22 mm without the water frozen. Furthermore, the length of 500 mm is specified in consideration, as an example, of freezing at a refrigerant temperature of −20 degrees C. to −25 degrees C. at which an operation lower-limit temperature of the air-conditioning apparatus is likely to be reached. Although this length is also influenced by an outside air temperature, whether freezing occurs or not can be determined by considering a temperature difference ΔT between −25 degrees C. and the outside air temperature. That is, as a designed temperature is −20 degrees C., the temperature difference ΔT between −20 degrees C. and the outside air temperature is used as the water temperature. For example, in a case where the outside air temperature is −5 degrees C., it can be regarded for convenience that the water temperature rises by a temperature difference 20 degrees C. from −25 degrees C.

Furthermore, as it is important to drain defrost water flowing through the water drainage grooves 51 from the water drainage holes 50 as promptly as possible, the water drainage surface 2*c* is inclined at a gradient. The gradient is specified more than or equal to 1/50, which is also used as a construction standard of a water conduit, as an angle necessary for causing defrost water to flow. The gradient of 1/50 creates a difference in height of up to 10 mm between the water drainage holes 50 of the water drainage surface 2*c*. Consequently, water drainage performance is improved. Furthermore, the water drainage holes 50 around the outdoor-side heat exchanger 13 and around the refrigerant pipe on which dew is formed each have a larger diameter than a diameter of water drainage holes 50*a* (see FIG. 6) located at other positions. Both of the gradient and the enlarged hole diameter can improve water drainage performance by 20% as compared with a case where the gradient and the enlarged hole diameter are not achieved.

As described above, according to Embodiment 1, the base 2 has three surfaces located at different heights, and the control box 40 is disposed on the topmost surface 2*b* located at the highest position among the three surfaces. With this configuration, the control box 40 can be made less likely to be immersed in defrost water.

Furthermore, the region where the control box 40 is disposed is surrounded by the water drainage surface 2*c* that is the lowest surface among the three surfaces. With this configuration, the control box 40 can be further made less likely to be immersed in defrost water.

As defrosting operation is performed, for example, at a cycle of approximately one time per hour as described above, a large amount of defrost water is generated in a high-humidity environment. Consequently, when water drainage performance is not sufficient, there is a risk of hindering maintenance because a panel at a space for maintenance cannot be detached because of ice grown on the base 2. However, in a case where water drainage performance is improved by employing the structure and the specifications of the base 2 described above, an advantage of ensuring serviceability is also produced.

Water drainage performance of not only defrost water but also water such as rainwater and dew condensation water can be improved by employing the above structure of the base 2. Consequently, accumulation of the water and immersion of the control box 40 in water caused by freezing of the water can be made less likely to occur.

Embodiment 2

Although a shape of the control box 40 is not specified in particular in Embodiment 1, the shape of the control box 40 is specified in Embodiment 2. Differences of Embodiment 2 from Embodiment 1 are mainly described below, and matters that are not described below are similar to those in Embodiment 1.

Figure 9:
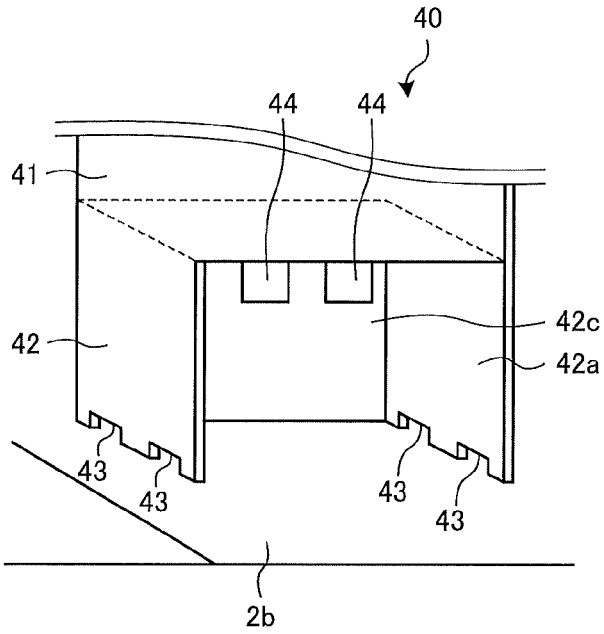
FIG. 9 is a perspective view schematically illustrating a control box provided in an outdoor unit of an air-conditioning apparatus according to Embodiment 2 of the present invention.

FIG. 9 is a perspective view schematically illustrating a control box provided in an outdoor unit of an air-conditioning apparatus according to Embodiment 2 of the present invention.

The control box 40 includes a box part 41 having a cuboid shape and in which components such as a control substrate (not illustrated) and an inverter substrate (not illustrated) are disposed and a leg part 42 extending downward from three edges of a lower surface of the box part 41 so that a space for heat transfer and electric wire routing is defined below the box part 41. The leg part 42 has a right leg part 42*a*, a left leg part 42*b*, and a rear leg part 42*c*. Each of the right leg part 42*a* and the left leg part 42*b* has a part that is in contact with the topmost surface 2*b* of the base 2 and in which recesses 43 each through which a wire passes are located. Furthermore, the rear leg part 42*c* has through-holes 44 each through which a wire passes.

Defrost water that falls from above the control box 40 is present on the topmost surface 2*b* on which the control box 40 is provided, and a volume of each of the recesses 43 is specified to more than 0 $cm^3$ and less than or equal to 10 $cm^3$ to prevent the defrost water from flowing into a space below the box part 41 of the control box 40. When a water temperature of the defrost water is 1 degree C., the volume of each of the recesses 43 is specified to less than or equal to 10 g in water amount, in other words, less than or equal to 10 $cm^3$ by considering an amount of ice that can be molten on the basis of an amount of sensible heat. By specifying the volume of each of the recesses 43 to this volume, it is possible to prevent defrost water in the recesses 43 from freezing when defrosting operation switches to heating operation and prevent defrost water from flowing into the space below the box part 41 from the recesses 43.

The space below the box part 41 is a space for electric wire routing as described above, and a large number of wires placed into the box part 41 are gathered in this space (not illustrated in FIG. 5). Consequently, the wires may be buried in ice in a case where defrost water flows into the space below the box part 41, remains in the space, and is frozen. In consideration of a possibility of immersion of the wires in water and influence of expansion of ice caused by a temperature change, defrost water is prevented from flowing into the space below the box part 41. Another reason why defrost water is prevented from flowing into the space below the box part 41 is that water is more likely to flow into the box part 41 when the ice grows to a height of the lower surface of the box part 41.

The leg part 42 is provided at right, left, and rear portions in FIG. 9, and the leg part 42 is not provided at a front portion, which is opened. Consequently, it is concerned that defrost water flows from the front portion into the space below the box part 41, but this inconvenience cannot be avoided. As described above, wires connected to the control box 40 are contained in the space below the box part 41. Consequently, the front portion needs to be opened to ensure maintainability. In a case where a leg part can also be provided on the front portion, a leg part is desirably provided on the front portion as inflow of water can be prevented more.

The control substrate and the inverter substrate disposed in the box part 41 easily generate heat while operating, and the heat is transferred to a heat transfer unit provided on the control substrate, but the heat is also transferred to air in the box part 41 in a large quantity. For this reason, it is also possible to provide a heat transfer hole (not illustrated) in a bottom surface of the box part 41 so that the heat transmitted to air in the box part 41 is transferred from the heat transfer hole to an outside of the box part 41 to prevent water that has fallen onto the base 2 from freezing or from growing as ice.

As described above, according to Embodiment 2, the following effects can be obtained in addition to effects similar to the effects of Embodiment 1. Specifically, as the leg part 42 of the control box 40 has, at a part of the leg part 42 that is in contact with the base 2, the recesses 43 each having a volume of more than 0 $cm^3$ and less than or equal to 10 $cm^3$, defrost water on the topmost surface 2*b* can be made less likely to flow into the space below the box part 41 of the control box 40. The recesses 43 each reduce an area of a surface of the leg part 42 provided on the base 2. Consequently, an effect of reducing chattering noise caused by vibration of the compressor 11 is also produced.

Embodiment 3

Embodiment 3 relates to a structure of water drainage from the outdoor-side heat exchanger 13 to the base 2. Differences of Embodiment 3 from Embodiment 1 are mainly described below, and matters that are not described below are similar to those in Embodiment 1.

Figure 10:
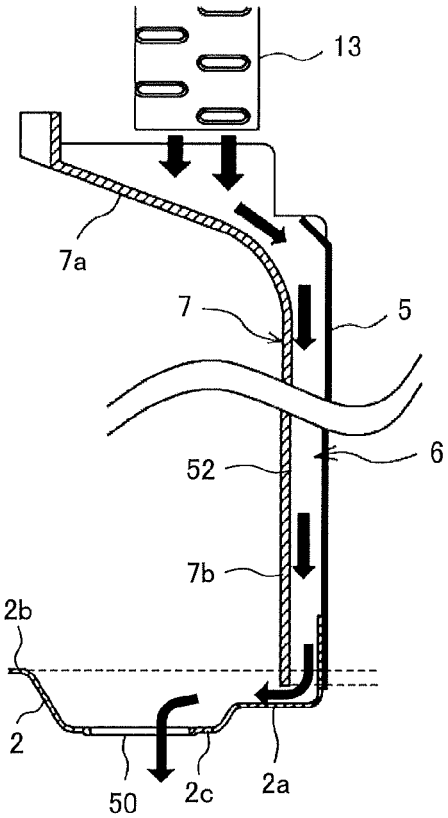
FIG. 10 is a cross-sectional view schematically illustrating a water drainage structure of an outdoor unit of an air-conditioning apparatus according to Embodiment 3 of the present invention.

FIG. 10 is a cross-sectional view schematically illustrating a water drainage structure of an outdoor unit of an air-conditioning apparatus according to Embodiment 3 of the present invention.

As illustrated in FIG. 10, a water guide plate 7 that receives defrost water generated on the outdoor-side heat exchanger 13 and guides the defrost water to one of the water drainage grooves 51 is disposed below the outdoor-side heat exchanger 13. The water guide plate 7 is disposed to face one of the side panels 5 with a space interposed between the water guide plate 7 and the one of the side panels 5 so that defrost water flows through a water drainage path 6 defined by the space between the one of the side panels 5 and the water guide plate 7.

The water guide plate 7 is a substantially flat plate, and an upper part of the water guide plate 7 is an inclined surface 7*a* that faces a lower surface of the outdoor-side heat exchanger 13 and extends diagonally downward from an inner portion toward an outer portion in the housing 1, and a lower part of the water guide plate 7 is a vertical surface 7*b* that extends vertically downward from a lower end of the inclined surface 7*a*. A lower end of the water guide plate 7 is located lower than the topmost surface 2*b* of the base 2.

When the water guide plate 7 is not disposed, a water droplet that has fallen from the outdoor-side heat exchanger 13 is likely to be scattered onto the topmost surface 2*b* of the base 2 because of influence of wind or other factors. Meanwhile, in a case where the water guide plate 7 is provided, defrost water that has dropped from the outdoor-side heat exchanger 13 can be guided downward through the water drainage path 6 and be guided to the water drainage grooves 51.

As described above, according to Embodiment 3, in which the lower end of the water guide plate 7 is located lower than the topmost surface 2*b*, it is possible to prevent defrost water that has dropped from the outdoor-side heat exchanger 13 from scattering onto the topmost surface 2*b*, in addition to effects similar to effects of Embodiment 1.

REFERENCE SIGNS LIST

1 housing 1*a* air inlet 1*b* air outlet 2 base 2*a* reference surface 2*b* topmost surface (high-level surface) 2*c* water drainage surface (low-level surface) 3 frame part 4 outdoor-side fan 5 side panel 6 water drainage path 7 water guide plate 7*a* inclined surface 7*b* vertical surface 10 outdoor unit 11 compressor 12 flow switching device 13 outdoor-side heat exchanger 13*a* outdoor-side heat exchanger 13*aa* heat transfer tube 13*b* outdoor-side heat exchanger 13*ba* heat transfer tube 15 accumulator 16 refrigerant pipe 17 refrigerant pipe 18 bypass 18*a* first bypass pipe 18*b* second bypass pipe 18*c* third bypass pipe 18*d* fourth bypass pipe 19 valve opening-closing device 20 indoor unit 21 indoor-side heat exchanger 22 expansion device 30 refrigerant pipe 40 control box 41 box part 42 leg part 42*a* right leg part 42*b* left leg part 42*c* rear leg part 43 recess 44 through-hole 45 heat transfer hole 50 water drainage hole 50*a* water drainage hole 51 water drainage groove 11 interval between water drainage holes 12 distance between part onto which defrost water falls and water drainage hole

The invention claimed is:

1. An outdoor unit of an air-conditioning apparatus, comprising:

a housing;

a heat exchanger provided in an upper part of an inside of the housing; and a control box disposed in the housing and configured to control the outdoor unit, the housing including a base on which the control box is disposed, the base being provided with a water drainage groove and a water drainage hole for draining defrost water generated on the heat exchanger to an outside, the base having three surfaces located at different heights that are, in order from top, a first surface, a second surface, and a third surface that is a bottom surface of the water drainage groove and is provided with the water drainage hole, the control box being disposed on the first surface, the control box having a box part and a leg part that extends downward from the box part, the leg part having, at a part of the leg part that is in contact with the base, a recess having a volume of more than 0 $cm^3$ and less than or equal to 10 $cm^3$.

2. The outdoor unit of an air-conditioning apparatus of claim 1, wherein a region where the control box is disposed is surrounded by the third surface.

3. The outdoor unit of an air-conditioning apparatus of claim 1, further comprising a water guide plate that is disposed below the heat exchanger, receives defrost water generated on the heat exchanger, and guides the defrost water to the water drainage groove, wherein a lower end of the water guide plate is located lower than the first surface.

4. The outdoor unit of an air-conditioning apparatus of claim 1, wherein the housing has a cuboid shape, and the heat exchanger is disposed along four surfaces in the housing.

5. The outdoor unit of an air-conditioning apparatus of claim 1, wherein a space below the box part is a space for electric wire routing and is a space in which wires are gathered, and the wires pass through the recess and placed into the box part.

6. An outdoor unit of an air-conditioning apparatus, comprising:

a housing;

a heat exchanger provided in an upper part of an inside of the housing;

a water guide plate disposed below the heat exchanger; and a control box disposed in the housing and configured to control the outdoor unit, the housing including a base on which the control box is disposed, the base being provided with a water drainage groove and a water drainage hole for draining defrost water generated on the heat exchanger to an outside, the base having three surfaces located at different heights that are, in order from top, a first surface, a second surface, and a third surface that is a bottom surface of the water drainage groove and is provided with the water drainage hole, the control box being disposed on the first surface, the water guide plate receiving defrost water generated on the heat exchanger, and guiding the defrost water to the water drainage groove, a lower end of the water guide plate being located lower than the first surface, the water guide plate including an inclined surface that faces a lower surface of the heat exchanger and a vertical surface that extends vertically downward from a lower end of the inclined surface.

7. The outdoor unit of an air-conditioning apparatus of claim 6, wherein a gap is formed between a bottom of the water guide plate and the base such that the defrost water can pass through the gap.

* * * * *